US011107322B1

(12) United States Patent
Kenney

(10) Patent No.: US 11,107,322 B1
(45) Date of Patent: Aug. 31, 2021

(54) NO RAKE PLATFORM

(71) Applicant: Paul Kenney, Peachtree Corners, GA (US)

(72) Inventor: Paul Kenney, Peachtree Corners, GA (US)

( * ) Notice: Subject to any disclaimer, the term of this patent is extended or adjusted under 35 U.S.C. 154(b) by 0 days.

(21) Appl. No.: 16/739,915

(22) Filed: Jan. 10, 2020

Related U.S. Application Data

(60) Provisional application No. 62/812,448, filed on Mar. 1, 2019.

(51) Int. Cl.
*G07F 17/32* (2006.01)

(52) U.S. Cl.
CPC ..... *G07F 17/3244* (2013.01); *G07F 17/3288* (2013.01)

(58) Field of Classification Search
CPC combination set(s) only.
See application file for complete search history.

(56) References Cited

U.S. PATENT DOCUMENTS

2011/0003634 A1* 1/2011 Manteris ..... G07F 17/32 463/25
2017/0165581 A1* 6/2017 McAuley ..... A63F 13/65

* cited by examiner

*Primary Examiner* — Corbett B Coburn
(74) *Attorney, Agent, or Firm* — Fish & Richardson P.C.

(57) ABSTRACT

Methods, systems, and apparatus, including computer programs encoded on a computer storage medium, for implementing no rake line wagering. In one aspect, a method includes accessing rake line data for an event. The accessed rake line data is converted into a no rake line. The no rake line is published to a wagering platform accessible by multiple members. The wagering platform includes multiple separate wagering groups that each include multiple members. At a pre-specified time relative to a start time of the sports event, locking any wagers made within a particular group based on the no rake line. An outcome of the sporting event is obtained. From among the wagers, winning wagers and losing wagers in the particular group are determined based on the outcome of the sports event and the no rake line. Accounts of the members in the particular group that wagered on the sporting event are updated.

20 Claims, 8 Drawing Sheets

NO RAKE PLATFORM

CROSS-REFERENCE TO RELATED APPLICATIONS

This application claims the benefit under 35 U.S.C. § 119(e) of U.S. Patent Application No. 62/812,448, entitled "NO RAKE PLATFORM," filed Mar. 1, 2019. The disclosure of the foregoing application is incorporated herein by reference in its entirety for all purposes.

BACKGROUND

Sports wagering is generally performed using either money lines or point spreads that reflect the likelihood of different outcomes. The money lines and/or point spreads are typically set so that there is a gap between what is paid in by the losing wagers and what is paid out on the winning wagers. This gap is referred to as the rake, which is generally retained by the entity that accepts the wagers.

SUMMARY

In general, one innovative aspect of the subject matter described in this specification can be embodied in methods that include the actions of accessing, by one or more computers of a wagering platform, rake line data for a sports event; converting, by the one or more computers, the accessed rake line data into a no rake line; publishing, by the one or more computers, the no rake line to a wagering platform accessible by multiple members, wherein the wagering platform includes multiple separate wagering groups that each include multiple members; for each particular wagering group from among the multiple separate wagering groups: at a pre-specified time relative to a start time of the sports event, locking, by the one or more computers, any wagers made within the particular group based on the no rake line; obtaining, by the one or more computers, an outcome of the sporting event; determining, by the one or more computers and from among the wagers, winning wagers and losing wagers in the particular group based on the outcome of the sports event and the no rake line; updating, by the one or more computers, accounts of the members in the particular group that wagered on the sporting event, including transferring the losing wagers to accounts of members that made the winning wagers; and alerting one or more members when the one or more members submitted the winning wagers. Other embodiments of this aspect include corresponding systems, apparatus, and computer programs, configured to perform the actions of the methods, encoded on computer storage devices.

These and other embodiments can each optionally include one or more of the following features. Converting the accessed rake line data into a no rake line can include eliminating a spread between a positive rake line specified by the rake line data and a negative rake line specified by the rake line data.

Converting the accessed rake line into a no rake line can include obtaining, for the sports event, a published positive rake line specifying an amount that will be won on a wager of a specified amount when a first outcome of the sports event occurs; obtaining, for the sports event, a published negative rake line specifying an amount required to be wagered in order to win the specified amount when a second outcome of the sports event occurs; and calculating an average of the published positive money line and an absolute value of the published negative money line.

Methods can include the actions of for each particular wagering group from among the multiple separate wagering groups: accepting, from members in that particular wagering group, wagers that each specify a predicted outcome of the sporting event picked by the member that submitted the wager; determining, at the pre-specified time, a total wager for each member in the particular wagering group based on a first number of the members in that particular wagering group that picked a first particular outcome of the sporting event and a second number of the members in that particular wagering group that picked a second particular outcome of the sporting event; and determining, for each member in that particular wagering group, the total wager for that sporting event based on the outcome of the sports event, the first number of members that picked the first particular outcome, and the second number of members that picked the second particular outcome, the no rake money line, and a group wager specifying a baseline wager amount for that particular wagering group.

Methods can include the actions of determining, for a particular member, a wagering limit based on an account balance of that particular member; and limiting access to that particular members selecting outcomes of various sports event that will result in the particular member's failure to cover a resulting losing wager, including: monitoring a given amount of potential losses that the particular member would incur for a given outcome of a particular sports event based at least in part on a number of members in a same wagering group as the particular member that picked an opposite outcome than the particular member; updating a total exposure of the particular member as the given amount of potential losses changes; and restricting the particular member from placing additional wagers when a difference between available account resources for the particular member and the total exposure for the particular member falls to a pre-specified threshold.

Methods can include the actions of providing, by the one or more computers, a wagering platform that is configured to accept updated wagers from members in a particular wagering group, transmit updated information to other members in the particular wagering group in response to acceptance of the updated wagers, and update potential winnings and losses in response to the accepted updated wagers, wherein the wagering platform is configured to maintain a same aggregate member account balance irrespective of the outcome of the sports event.

Methods can include the actions of transmitting to client devices of members in each of the multiple separate different wagering groups status updates during the sports event, the status updates including at least one of a current score of the sports event, a relative amount of time remaining in the sports event, total potential win amounts, or total potential loss amounts for each of the members.

Methods can include the actions of receiving a request to access the wagering platform; determining a geographic location of a client device from which the request to access the wagering platform is being submitted; regulating access to the wagering platform based on the geographic location, including: denying access to the wagering platform when the request is being submitted from within a geographical region in which access to the wagering platform is prohibited by law; and granting access to the wagering platform when the request is being submitted from within a geographical region in which access to the wagering platform is allowed by law.

The techniques discussed in this document provide a wagering and communications platform that enables groups of members to wager directly with others in the group using a no rake line, thereby eliminating the per-outcome fee that is generally retained by entities that accept wagers. The wagering platform also provides a wagering environment in which an aggregate amount of money held by a set of members does not change because of the outcome of a sports event or the money line for the sports event. That is, the positive money line and the negative money line for a specific sports event has the same magnitude, such that the outcome of the sports event results in a complete transfer of losses from the losing wagers to winning members that placed the winning wager. This complete transfer of losses to winners results in a more efficient wagering platform that allows groups of members to engage in friendly wagering without paying a per-outcome fee for the use of the wagering platform. The wagering platform generates the no rake money line by removing the spread between published positive money line(s) for a particular sporting event and the published negative money line(s) for the particular sporting event. This enables the members the opportunity to wager on true outcome odds.

The manner in which accounts are updated after each sports event reduces the number of financial transactions that need to be made, which reduces the number of calls to a third party finance system, thereby reducing the number of network call, amount of online traffic, and processing resources required. For example, by simply updating a database record of the winners and losers, (e.g., rather than having to transfer funds between member's bank accounts), the system need not make external API calls to a server of a financial institution or payment processing server, thereby reducing the amount of traffic on these servers. When aggregated over millions upon millions of members and hundreds of sports event outcomes each day, the reduction in strain on these servers and other data processing resources is easily comprehended. Furthermore, member privacy and data security can be enhanced because of the reduced amount of network traffic that is generated by not continually transmitting personal financial information over the Internet. Rather, until a member initiates a transaction (e.g., adding funds to their account or removing funds from their account), all account updates can be performed within the wagering platform itself, thereby reducing the risk of third-parties intercepting the member's personal financial information from calls to third-party systems.

The manner in which the wagering groups are created provides limits on amounts that can be wagered by an individual member on an individual game, thereby reducing the ability for a member to go "all in" on a single sports event. For example, the amount wagered on each event is limited by the baseline wager for the group to which the member belongs. Therefore, the member cannot simply decide to place a bigger wager, as the wagers are of a standard form as pre-specified for each particular group. This baseline wager technique provides safe guards relative to traditional wagering environments in which a member could simply continue to wager larger and larger or drastically varying their wager over time. The baseline wager technique also provides a more consistent fun environment for a group of members, as the members enter the group with an understanding as to how the wagers in that group are structured, and an assurance that they are joining a group with a wager structure that is within their comfort zone.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This document describes a wagering platform that facilitates wagering among a group of members (also referred to as users) using a "no rake line". As used throughout this document, a "no rake line" refers to a money line (or points spread) in which the amount lost by losing wagers equals the amount transferred to members that placed winning wagers. In other words, the entity operating and/or providing the wagering platform is not taking a per-outcome amount (or rake) that results from spreads that are built into traditional published money lines or points spreads. As such, the wagering platform discussed herein provides a transparent wagering environment in which the members get to wager on "true odds" rather than odds that have been modified to provide a cut of the wagers to the entity taking the wagers.

As described in more detail below, the no rake line can be generated (or derived) from publicly available information. In some situations, the no rake line can be generated using positive and negative money lines that are published by traditional wagering entities. For example, the no rake line can be an average of the positive money line and the absolute value of the negative money line for a particular sports event. In this way, the rake that would traditionally go to the entity accepting the wagers is equally allocated to the members that wager on each of the different outcomes for the sports event. As such, when an event has completed, the amount won by members in a particular wagering group is equal to an amount lost by other members in that particular wagering group, such that the aggregate amount in the accounts of members in that particular wagering group has not changed because of the outcome of the sports event.

The manner in which members are grouped together in wagering groups and additional details regarding the amounts won and lost by various members within each particular wagering group are discussed in more detail below. The description generally describes the operations, processes, and techniques with reference to a no rake money line, but the descriptions are equally applicable to a no rake points spread, or other appropriate ways in which members can wager against each other.

Figure 1:
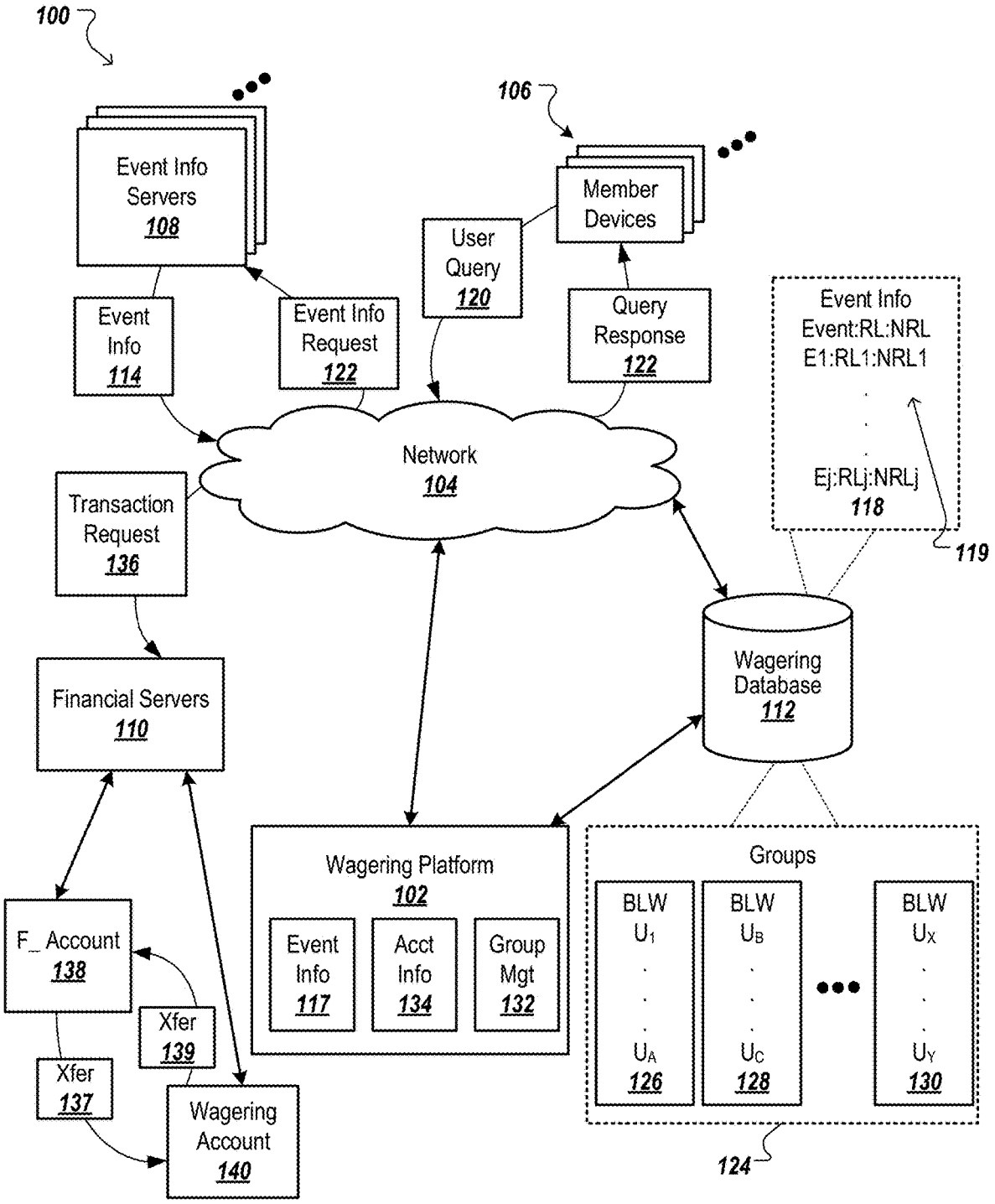
FIG. 1 is a block diagram of an example environment in which no rake wagering can be implemented.

FIG. 1 is a block diagram of an example environment 100 in which a wagering platform 102 can be implemented. The example environment includes a network 104, such as a local area network (LAN), a wide area network (WAN), the Internet, or a combination thereof. The network 104 connects member devices 106, event information servers 108, financial servers 110, and a wagering database 112.

A member device 106 is an electronic device that is capable of requesting and receiving resources over the network 104. Example member device s 106 include personal computers, mobile communication devices, tablet devices, digital assistant devices (e.g., that respond to voice commands and provide information by way of audio feedback), and other devices that can send and receive data over the network 104. A member device 106 typically includes a user application, such as a web browser, to facilitate the sending and receiving of data over the network 104, but native applications executed by the member device 106 can also facilitate the sending and receiving of data over the network 104.

The wagering platform 102 can include one or more data processing apparatus (e.g., servers, computers, or other data processing devices). The wagering platform 102 can be a cloud-based architecture that utilizes a set of shared computing devices so that the actual computing devices being utilized to implement the wagering platform 102 can be scaled upon member demand. For example, the number of members utilizing the wagering platform 102 at any given time will fluctuate based on a number of factors. For instance, days on which there are a large number of sporting events (e.g., Saturdays during college football season or Sundays during the National Football League season) will generally require more computing resources to handle the amount of traffic to the wagering platform than will be required for days on which there are very few sporting events. By implementing the wagering platform 102 on a cloud based shared computing architecture, this fluctuation in resource demand can be handled efficiently due to the ability to scale the amount of computing resources allocated to the wagering platform on the fly. As such, there will be fewer instances in which a lack of computing resources will lead to unavailability of the wagering platform 102 to members, thereby resulting in a more robust system that is less susceptible to outages.

The wagering platform 102 is responsible for collecting event information 114 to facilitate the no rake wagering. The wagering platform 102 can collect this event information 114, for example, through communications with one or more of the event information servers 108. The event information servers 108 can be operated by various entities that publish event information about sporting events (and/or other events on which members can wager). The event information about the sporting events (and/or other events) can include teams that are competing in the event, a time of the event, a location of the event, historical information as to outcomes of prior events in which the teams competed (e.g., scores of previous games involving the two teams), a lifetime record of outcomes for events in which the participating teams competed, recent news related to the event (e.g., player injury updates, weather conditions, and/or other information relevant to the event), and one or more wagering lines (e.g., rake lines) for the event. The wagering lines can include a rake money line, a rake point spread, and/or other types of rake wagering lines, such as over/under lines.

To collect this event information 114, the wagering platform 102 can generate an event information request 116 that is transmitted to one or more of the event information servers 108. The event information request 116 can take the form of a packetized data request that is sent over the network 104. For example, the event information request 116 can have a header that specifies the server to which the event information request 116 is destined (among other information), and a payload that specifies the event information being requested (among other information). In some situations, the event information request 116 is formatted as an API request that is transmitted by the wagering platform 102 over the network 104 to the event information servers 108.

The event information request 116 can specify that event information is being requested for a particular event (e.g., a particular football game or other sporting event), or the event information request 116 can specify that the event information being requested is for any any/or all events for which event information is available or for any/or all events occurring within a specified timeframe (e.g., the next week, month, 3 months, or any other appropriate timeframe) or for a specified sports league (e.g., National Football League, college football, National Basketball League, National Hockey League, Major League Baseball, Major League Soccer, or any other sports league).

The wagering platform 102 obtains the event information 114 from the event information servers 108 in response to the event information request 116. In some implementations, the event information 114 is received and/or processed by an event information engine 117 that is part of the wagering platform 102. The event information engine 117 can be implemented as instructions that define the operations performed by the wagering platform 102 with respect to obtaining, processing, and/or distributing event information 114 and/or other information about various events. For example, the event information engine 117 can cause the wagering platform 102 to store the received event information 114 in the wagering database 112. In some implementations, the wagering platform 102 indexes the event information 114 on a per-event basis. For example, as shown in FIG. 1, the index 118 can organize the event information 114 on a per-event basis, such as by indexing a rake line ("RL1") to a corresponding event ("E1"). The rake line, R1, can be current published wagering line information that is set to include the rake. The event information engine 117 can include instructions that cause one or more data processors to perform operations as described throughout this document, and can also include the one or more processors.

In addition to storing the event information 114 received from the one or more event information servers 108, the wagering platform 102 (e.g., by way of the event information engine 117) can also generate new data (e.g., data that didn't previously exist) related to any of the events for which the event information 114 was received. The new data generated by the wagering platform 102 can include a no rake line 119 ("NRL") that will be used to facilitate wagering within the wagering platform 102. For example, NRL1 that is determined for Event E1 based on the rake line information RL1 for Event E1 can be indexed to E1. As discussed in more detail below, the no rake line can be generated using one or more of the rake lines received in the event information 114. The new data generated by the wagering platform 102 (e.g., the no rake line 119) can also be indexed to the event for which new data was generated.

Indexing the event information 114 and the newly generated data (e.g., the no rake line) enables the wagering platform 102 to respond to member queries 120 for event information. More specifically, each member query 120 can request information about one or more events. In response to receiving the member query 120, the wagering platform 102 (e.g., by way of the event information engine 117) can access the wagering database 112 to identify the event entries relevant to the one or more events. In some implementations, the wagering platform 102 can search the database for the event entries that are indexed to the one or more events for which information is being requested. For example, the wagering platform 102 can identify each event entry (e.g., a row of information) in the wagering database 112 that is indexed to a particular sport or sporting league for which information is being requested by way of the member query 120. Once the wagering platform 102 has identified the relevant event entries, the wagering platform 102 can generate a query response 122 that includes information from the identified event entries (including the no rake line), and transmit the query response 122 to the member device 120.

The event information servers 108 can provide event information for any event that is scheduled to occur, as well as information for ongoing/completed events. For example, in addition to the event information listed above, the event information servers 108 can also provide in-event information and/or post-event information. As used throughout this document, the term in-event information refers to information about an event that is currently in progress, such as information generated during the event (e.g., a score, news, or weather update generated during the event). As used throughout this document, the phrase post-event information refers to information specifying an outcome of an event (e.g., score, winner, or loser) and/or information generated after the outcome of an event (e.g., an injury report or detailed box score analysis). This information for ongoing/completed events can be provided to member devices 106 in a similar manner as discussed above (e.g., in response to a member query 120). All of the information discussed above can also be provided to member devices as push notifications as appropriate.

The wagering platform 102 can be configured to enable wagering among a closed group of members. For example, the wagering platform 102 can create multiple different member groups 124, and enable members of each member group (e.g., 126, 128, and 130) to wager against each other (i.e., members in the same group) using a no rake line, rather than wagering against the wagering platform 102 using a rake line as is generally the case with traditional wagering systems. As discussed in more detail below, the head to head nature of member wagering using the no rake line means that the money that is won by members in a particular group is the amount of money lost by other members in that same particular group. Furthermore, the amount of money won/lost in a particular group is not influenced or affected by any activity in other groups wagering using the wagering platform 102 or due to a cut taken by the wagering platform 102 itself.

Before a member places a wager though the wagering platform 102, the member will need to join a group (e.g., group 126) that is created within the wagering platform 102. The member can join a group in various ways. For example, a member can be invited to join a particular group by an existing group manager or group member. In this scenario, the particular group has already been created (e.g., by the group manager), and the group manager (or another member of the group) can invite other members to join the particular group. The invitation can take the form of an email, instant message, social media post, or another electronic communication. The invitation can include a hyperlink and/or unique code that links the invitation to the particular group. For example, in the case of a hyperlink, the unique code can be appended to the URL to validate the member as having been invited to join the group.

In some situations, the member can be provided with the unique code, which could take the form of a group name and invitee password. This group name and invitee password can be entered, by the invited member, into a member interface of the wagering platform 102 to validate that member as an invitee to the particular group. Using the invitation/unique code process of adding members to a particular group enables members of that particular group to limit membership to the group as they see fit. For example, a group of friends who want to wager against each other can elect to only invite their friends to become members of the group. Additionally, groups can be deemed "private groups" by the creator/manager of the group (e.g., a member that created or manages the group), which will prevent the existence of the group from being made public to other members of the wagering platform 102, and also prevent members from joining that particular group without the appropriate credentials (e.g., the unique code).

Additionally, or alternatively, a member can join a particular group by finding a "public group." The creator of a public group can opt to allow other members to find the group, for example, using a search function of an application (e.g., mobile application) provided by the wagering platform 102. For example, a particular member can search for groups using a baseline wager amount. As used throughout this document, the term baseline wager amount is the standard wager amount for a group. For example, as discussed in more detail below, a baseline wager amount of $10 refers to the wager amount that is used to determine the winnings/losses of each member in the group. Thus, when a member searches for public groups having a baseline wager amount of $10, the wagering platform 102 (e.g., by way of the group management engine 132) can identify each public group having a baseline wager amount and present a list of these groups to the member in response to the search. The member can then select a group from the list to request access to that group. In the context of "public groups" the group manager can still be provided the ability to approve/reject access to any member (e.g., based on a platform wide rating of that member by other members).

As members become members of various groups, the wagering platform 102 keeps track of the members in each group (e.g., by way of the group management engine 132). For example, as shown in FIG. 1, the wagering platform 102 can store group information about the different member groups, including each group's baseline wager (e.g., BLW1, BLW2, and BLW3) and the members that are members of each group. More specifically, as shown in FIG. 1, the group information specifies that Group 1 126 has a baseline wager of $10 and includes members U1-UA, Group 2 has a baseline wager of $50 and includes members UB-UC, and that Group 3 has a baseline wager of $100 and includes members UD-UE. The wagering platform 102 can update this group information as members join/leave groups and/or when a manager of a group changes any characteristics of the group, such as the baseline wager for the group. The wagering platform 102 can store this group information in the wagering database 112 or another database.

In order to place a wager, members must fund their accounts. To facilitate this funding process, the wagering platform 102 can communicate with a one or more financial servers 110. Each financial server 110 can be provided by, or operated by, a financial institute or financial transaction processing entity. For example, a financial server can be provided by a bank, a payment processing system, and/or another financial transaction platform.

When a member registers with the wagering platform 102 and/or joins a group, the member can be provided with the ability to fund their account through interaction with the application used to access the wagering platform. For example, the application can include an interface that enables the member to enter their relevant financial account information and an amount of money that the member would like to add to their account within the wagering platform 102. Using this information, the wagering platform 102 generates a financial transaction request 136 that is transmitted to the financial server 110 that is responsible for completing a transfer 137 of funds from the member's financial account 138 ("F_Account") to the member's wagering account 140 within the wagering platform 102. The financial server 110 will then carry out a transfer of the funds from the member's financial account 138 to the member's wagering account 140, thereby enabling the member to wager within the wagering platform 102. Another transfer 139 can be facilitated from the member's wagering account 140 to their financial account 138, as well. The wagering account 140 can be maintained by a financial institute or by the wagering platform 102 itself.

Once two or more members in a particular group (e.g., a same group among the multiple different groups) have funded their accounts, wagering within that group can commence. The wagering within the particular group can take place across multiple different sporting events at one time, For purposes of example, the wagering within the particular group will be described with reference to a single sporting event, which is referred to as a particular sporting event.

Prior to the particular sporting event, the wagering platform 102 obtains (or accesses) rake line data for the particular sporting event. For purposes of this example, assume that the particular sporting event is a football game. In this example, the wagering platform 102 can access the event information servers 108 to obtain event information 114 that includes a rake money line for the football game (i.e., the particular sporting event). Assume that the rake money line is +220 for the underdog (e.g., the football team not favored to win), and −180 for the favorite (e.g., the football team favored to win).

The wagering platform 102 proceeds to convert the rake money line into a no rake line for the football game (i.e., the particular sporting event). In some implementations, the wagering platform 102 converts the rake money line into a no rake line by taking an average of the absolute values specified in the rake money line. In the present example, the wagering platform 102 can convert the rake money line into the no rake line as follows $(|220|+|-180|)/2$. In this example, the no rake money line, as determined by the wagering platform, would be 200 (e.g., 400/2).

Once the no rake money line has been determined, the wagering platform 102 can publish the no rake line for the football game (e.g., 200) to the members of the particular group. In some implementations, the wagering platform 102 publishes the no rake line to the members of the particular group by listing the no rake line in a member interface generated by the wagering platform 102. More specifically, the wagering platform 102 can generate a visualization of the no rake line, and present it to each of the members of the particular group as each of the members accesses a web interface or native mobile application interface that provides access to the wagering platform 102. In some implementations, the wagering platform 102 can generate a push notification that is transmitted to a device (e.g., a mobile device) of each of the members of the particular group informing those members of the no rake line for the football game. The push notification can be generated to include a link that causes the device to navigate to a web interface of the wagering platform 102 or launch a native mobile application that provides access to the wagering platform 102.

Once the no rake line has been published, members of the particular group are authorized to specify a predicted outcome for the football game (i.e., the particular sporting event). A predicted outcome is generally specified by each member specifying the entity (e.g., team or person) that they expect to win a particular sporting event. In the present example, the predicted outcome of each member would specify which football team that member expects to win the football game. The predicted outcome could be specified, for example, by each member clicking on a member interface component (e.g., check box, button, or other member interface component) corresponding to the entity that the member believes will be the victor in the particular sporting event.

In the present wagering platform 102, members of the particular group need not specify a total amount that they are wagering on any particular sporting event because the total amount wagered is going to be determined as a function of the baseline wager amount for the group and how many members selected each outcome for the particular sporting event, as discussed in more detail below. This simplifies the wagering process and limits the information required to be supplied by each member to their respective predicted outcome. In fact, the total wager of each member is only set when wagering on the particular sporting event within the particular group has been locked.

Wagering within the particular group for a particular sporting event is locked at a pre-specified time prior to the particular sporting event (or at a start of the particular sporting event). Locking of wagering within a group refers to preventing any further wagers to be made with respect to a particular sporting event. The pre-specified time can be selected by an administrator of the group, and can be any appropriate time (e.g., 10 minutes, 1 hour, 1 day, or any other appropriate amount of time). Once wagering on a particular sporting event has been locked, no existing wagers can be changed for that particular sporting event.

Once wagering, within the particular group, has been locked for the particular sporting event, the total wager of each member of the particular sporting event can be determined by the wagering platform 102. The wagering platform 102 can determine the total wager for each member based on a function of the baseline wager for the particular group, the no rake line, a number of members that selected a same outcome as that member, and a number of members that selected an opposite outcome than that member.

Continuing with the example above, assume that the no rake line is 200 and that the baseline wager for the particular group is $10. Further assume that there are five members in the particular group (e.g., M1-M5), and that the members of the group specified their predicted outcomes as shown below in Table 1.

TABLE 1

| Underdog Victory | Favorite Victory |
|---|---|
| M1 | M4 |
| M2 | M5 |
| M3 | |

As shown, members M1-M3, each predict that the underdog team will win—and are wagering on the underdog team, whereas each of M4 and M5 predict that the favorite team will win—and are wagering on the favorite team. In the present example, each member that selects the underdog is wagering the baseline amount of $10, while wagering platform 102 will compute the total wager of each of M4 and M5 as (200/100)*(3/2)=30, where 200 is the no rake money line, and the ratio 3/2 represents a number of members against the member (e.g., members that selected the other entity to win) relative to the number of members that are on a same side as the member (e.g., the total number of members that predicted the same winner as the member).

More generally, the wagering platform 102 determines a total wager for each member as follows. The wagering platform 102 determine, for each member an initial money line wager. The wagering platform can set the initial money line wager for each member that selects the underdog as the predicted winner to the baseline wager for the particular group, e.g., $10 in the example above. Meanwhile, the wagering platform 102 can set the initial money line wager for each member that selects the favorite as a product of the baseline wager for the particular group and a normalized no rake money line. The normalized no rake money line specifies a multiple that is won by members who select the underdog as the predicted winner. Continuing with the example above, the no rake money line is 200, so the normalized no rake money line can be 200/100 (e.g., NRML/100, where NRML is the no rake money line). Thus, the initial money line wager for each member that selects the favorite as the predicted winner will be set to $20 by the wagering platform in the present example.

The wagering platform 102 uses the initial money line wagers and the numbers of members within the particular group that select each of the favorite and the underdog to determine a total wager for each member. Generally speaking, when the number of members within a particular group that select the favorite is the same as the number of members in that particular group that select the underdog, the wagering platform 102 will set the total wager of each member in that particular group to their respective initial money line wager. However, when the number of members that select each of the favorite and underdog differ, a first set of the members (e.g., either those that selected the favorite or those that selected the underdog) will have their wager set to the initial money line wager, while the other set of members (e.g., the members that selected the opposite of the favorite or the underdog relative to the first set of the members) will have a total wager that differs from their initial money line wager.

More specifically, the wagering platform 102 determines which of the favorite or the underdog has been selected by more members of the particular group, which is referred to herein as the popular pick. The wagering platform 102 sets the total wager for each member that selected the popular pick to their initial money line wager. The wagering platform 102 determines the total wager for those members of the particular group that selected the unpopular pick (i.e., the entity that was selected by fewer of the members) based on a ratio of the number of members that selected the popular pick relative to the number of members that selected the unpopular pick. More specifically, the total wager for each member that selects the unpopular pick can be determined as IMLW*#PP/#UP, where IMLW is the initial money line wager for the member that selected the unpopular pick, #PP is the number of members that selected the popular pick, and #UP is the number of members that selected the unpopular pick.

Continuing with the example above, the underdog was the popular pick because three of the members of the particular group selected the underdog, while only two members selected the favorite. As such, the wagering platform 102 recognizes the underdog as the popular pick, and the favorite as the unpopular pick. In this example, the wagering platform 102 sets #PP to 3, and sets #UP to 2. Because the wagering platform 102 wagering platform determines the total wager for each of the members that selected the unpopular pick as $20*3/2=$30. Thus, the total wager for each member that selected the favorite as the predicted winner (i.e., the unpopular pick) in this example, will be $30, while the total wager for each member that selected the underdog as the predicted winner (i.e., the popular pick) in this example, will be $10.

During the particular sporting event, the wagering platform 102 can transmit, to client devices of members in each of the multiple separate different wagering groups, status updates related to the sporting event. The status updates can include at least one of a current score of the sports event, a relative amount of time remaining in the sports event, total potential win amounts, or total potential loss amounts for each of the members.

At the completion of the particular sporting event, the wagering platform 102 can determine which of the members' wagers are winning wagers, and which of the members' wagers are losing wagers based on the outcome of the particular sporting event. For example, if the underdog (e.g., the entity corresponding to the positive rake money line) is victorious, the wagering platform 102 will classify the wagers that specified the underdog as the predicted winner as winning wagers. Similarly, the wagering platform 102 will classify the wagers that specified the favorite (e.g., the entity corresponding to the negative rake money line) as the predicted winner as losing wagers.

The wagering platform 102 updates the accounts of members in the particular group based on the outcome of the particular sporting event. In some implementations, the wagering platform 102 transfers total losses of losing wagers out of members' accounts that placed the losing wagers, and transfers total winnings of each winning wager into the account of each member that placed a winning wager. As noted above, the total losses of all losing wagers within a particular group will match the total winnings of all wining wagers in that group so that the total amount of money within that particular group does not change based on the outcome of an individual sporting event. Thus, there is no inherent loss (e.g., by way of amounts collected by the wagering platform 102) when members of a particular group wager against each other. This is an improvement over traditional wagering platforms that collected a portion of amounts wagered. Furthermore, this type of "no rake" wagering is unconventional relative to traditional wagering platforms.

When the underdog is the winner, the total amount wagered by the members in the particular group on the favorite will be distributed equally among the members that selected the underdog as the predicted winner. Similarly, when the favorite is the winner, the total amount wagered on the underdog by the members in the particular group will be distributed equally among the members that selected the favorite as the predicted winner.

Continuing with the example, when the favorite is the winner, the amount distributed to M4 and M5 will be $15 each because the sum of the total wagers of M1-M3 on the underdog is $30 (i.e., $10+$10+$10), and that sum is split among the members M4 and M5 that selected the favorite as the underdog. On the flip side, when the underdog is the winner, the amount distributed to M1, M2, and M3 will be $20 each because the sum of the total wagers placed by M4 and M5 is $60 (i.e., $30+$30), and that sum is equally split among the members M1, M2, and M3.

FIGS. 2A-2E are illustrations that depict member interactions that can occur with an application provided by the wagering platform 102. The illustration of FIG. 2A includes a member interface 202 that can be presented to a member that is accessing the application provided by the wagering platform 102. This member interface 202 can include an ID box 204 and a password box 206. The ID box 204 is configured to receive input of a member identifier from a member that is requesting access to the wagering platform 102. The wagering platform 102 obtains input submitted through the ID box 204 and the password box 206, and regulates access to the wagering platform 102 based on the input. For example, when the combination of information submitted through the ID box 204 and the password box 206 matches a member identification/password combination of a registered member, the wagering platform 102 can grant access to the wagering platform, whereas the wagering platform 102 can deny access when the submission fails to match the member identification/password combination of a registered member.

In some implementations, access to the wagering platform 102 is also regulated based on a geographic location from which access is being requested. For example, when the request to access the wagering platform 102 is received, the wagering platform 102 can determine a state (or other geographic region) from which the request to access the wagering platform 102 is being submitted. When the request is being submitted from within a geographical region in which access to the wagering platform 102 is prohibited by law, the wagering platform can deny access to the wagering platform 102. When the request is being submitted from within a geographical region in which access to the wagering platform 102 is allowed by law, the wagering platform 102 can grant access to the wagering platform 102. This geographic regulation of access helps reduce the likelihood of a member accessing the wagering platform 102 when they are in a state that does not allow wagering on sporting events.

Figure 2A:
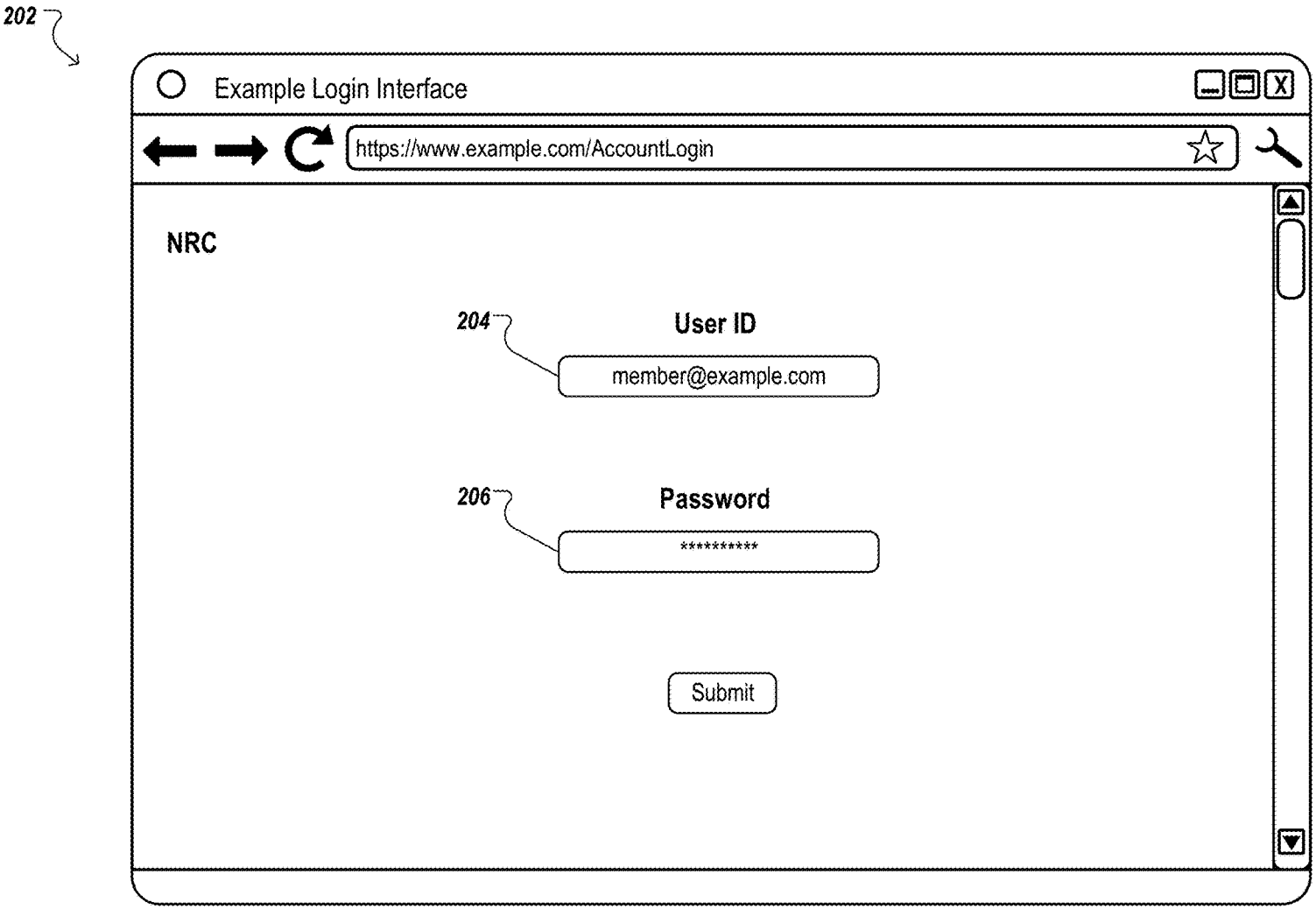
FIGS. 2A-2E are illustrations of example member experiences utilizing a no rake wagering application.
Figure 2B:
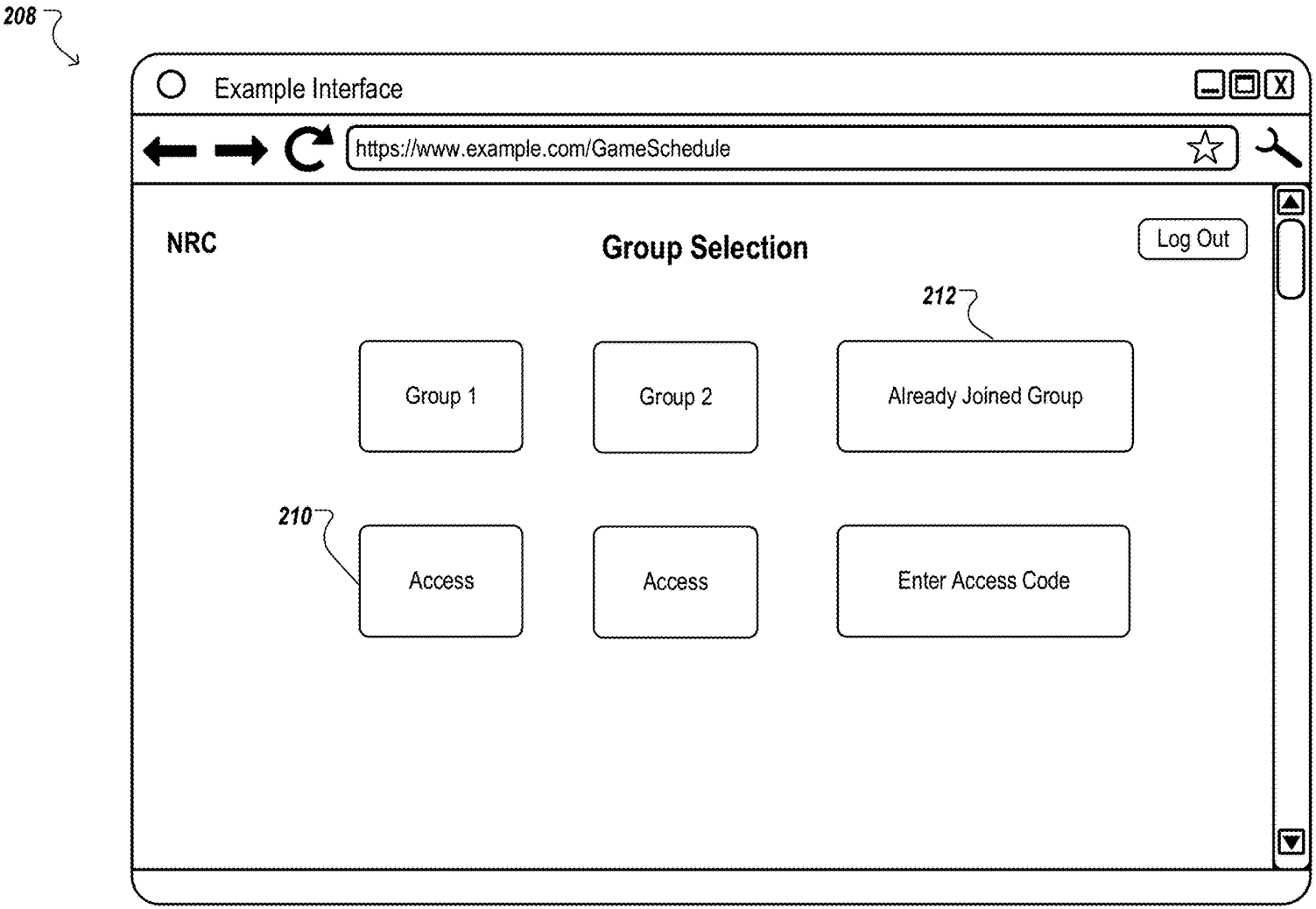

When the member is granted access to the wagering platform 102, the member can be presented with a group selection interface 208, as presented in FIG. 2B. The group selection interface 208 enables the member to request access to a new group, for example, by interacting with an access button 210, or another member interface component that directs the member to request access to a group. As discussed above, the member can request access to a group to which they have been invited (e.g., by entering information about that group). The member can also request access to a public group if public groups are made available. The particular interfaces used to request access to a new group are not discussed in detail herein. The group selection interface 208 also enables the member to access a particular group that they have already joined, for example, through interaction with a registered group button 212 (or other member interface component). A separate registered group button can be provided for each group to which the member belongs, or the member can be provided with a drop down menu or another appropriate member interface component that specifies which group the member is accessing.

Figure 2C:
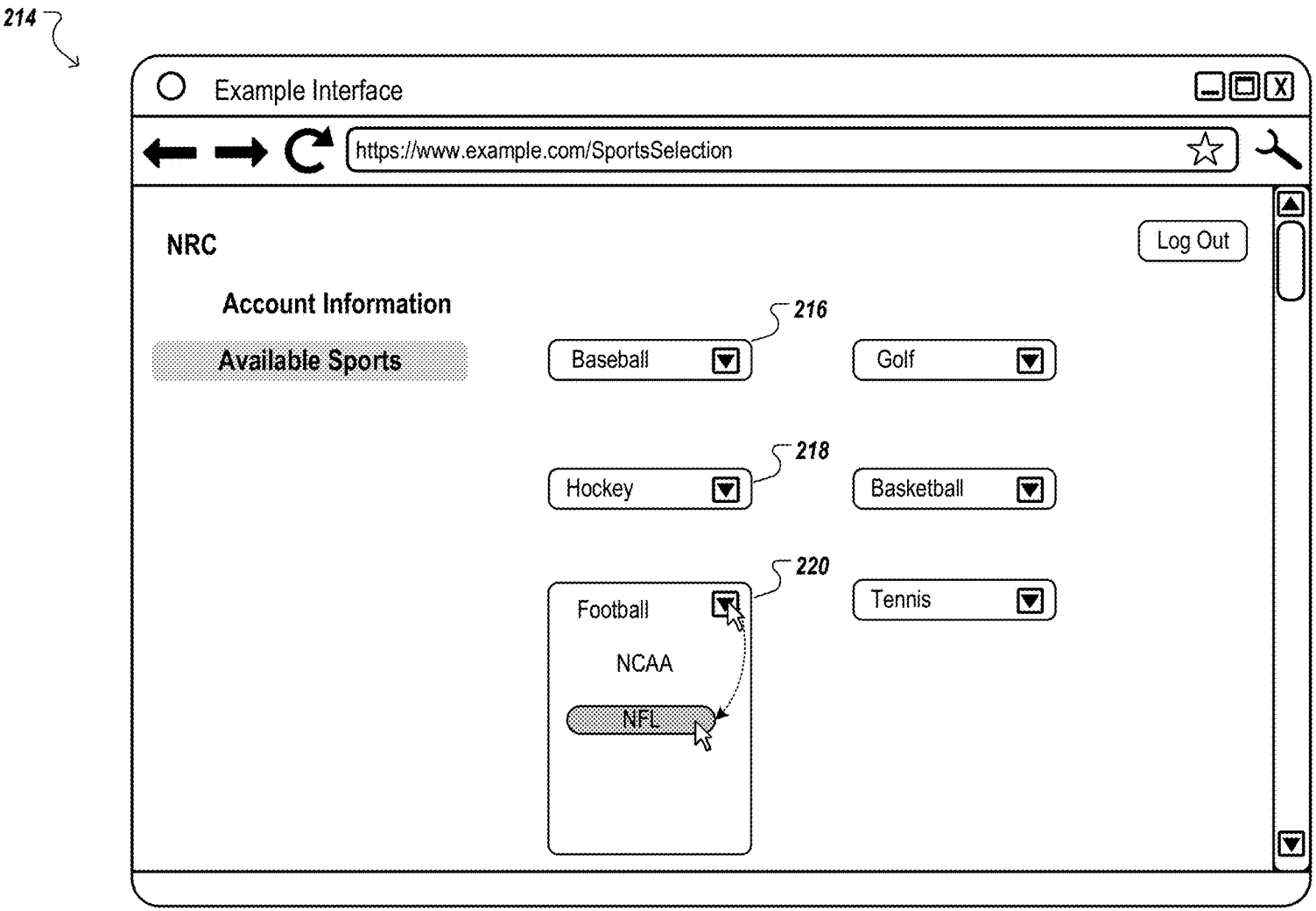

Interaction with the registered group button 212 can trigger presentation of an available sports member interface 214, as presented in FIG. 2C. The available sports member interface 214 can provide a list of sports that are available for wagering within the particular group being accessed by the member. The list of sports identified in the available sports interface 214 can be specified by a manager/administrator of the group, or can be a list of all sports supported by the wagering platform. The available sports interface 214 can include a separate sports control (e.g., 216, 218, 220) for each respective sport that is available for wagering within the particular group. In FIG. 2C, the sports controls are shown as drop down components that reveal available leagues of sports in response to user interaction with the corresponding control. For example, interaction with the sports control 220 for "Football" can trigger presentation of a dropdown that lists NCAA and NFL leagues, as well as any other football leagues that may be available for wagering.

Figure 2D:
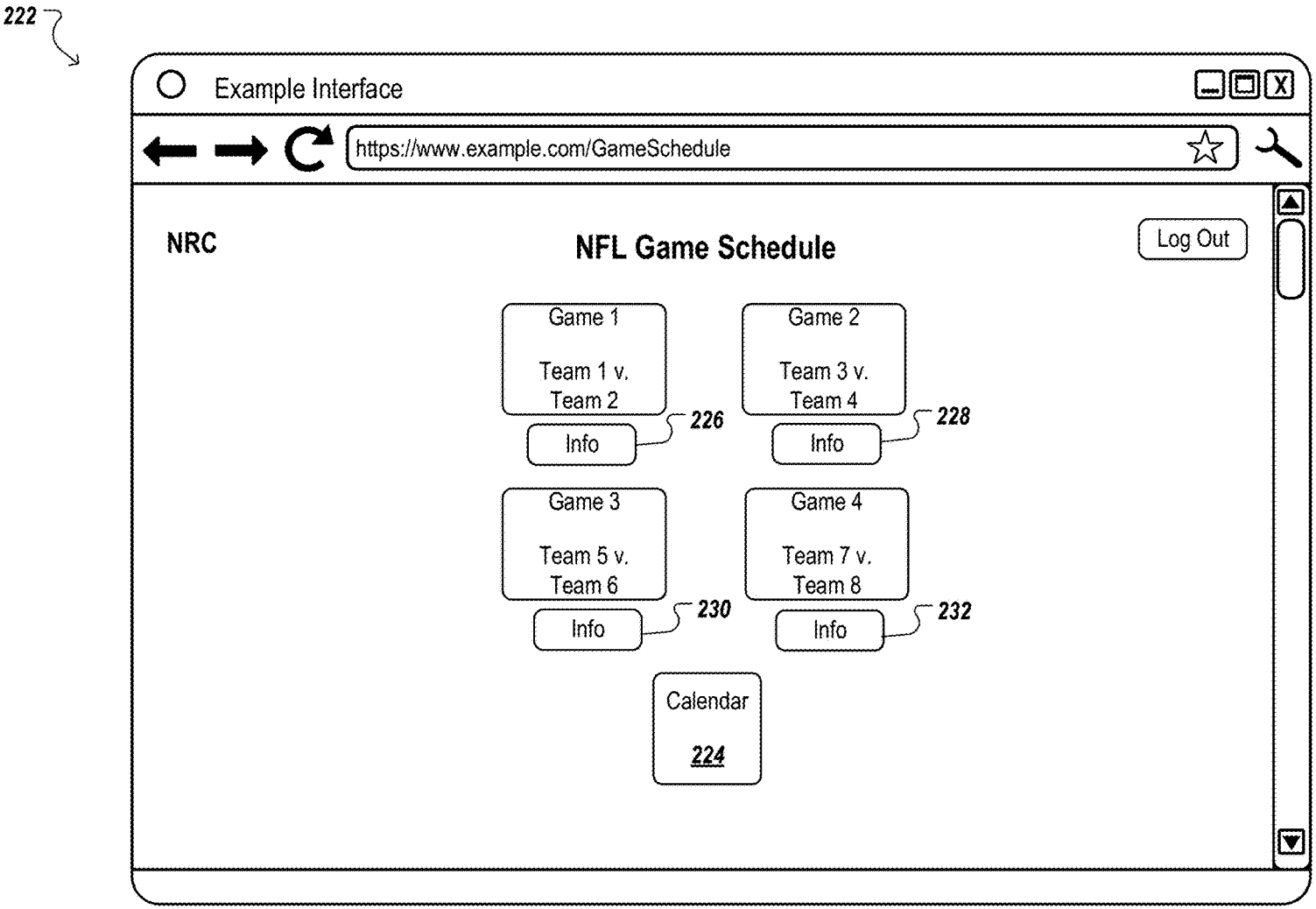

Member interaction with one of the listed leagues (or another type of selection of a particular sport and/or league) will trigger presentation of a corresponding active events interface 222, as shown in FIG. 2D. The active events interface 222 can include a listing of sporting events that are scheduled for the sport corresponding to the selection from the available sports member interface 214. In some implementations, the events listed in the active events interface 222 can be the next games for each team (or other sports entity) or the current week's games. The active events interface 222 can include a calendar component 224 that enables the member to select a particular day, and have events on that particular day presented. Each event listed in the active events interface 222 can have a corresponding button (e.g., 226, 228, 230, 232) or another member interface component that trigger presentation about that event (e.g., game).

Figure 2E:
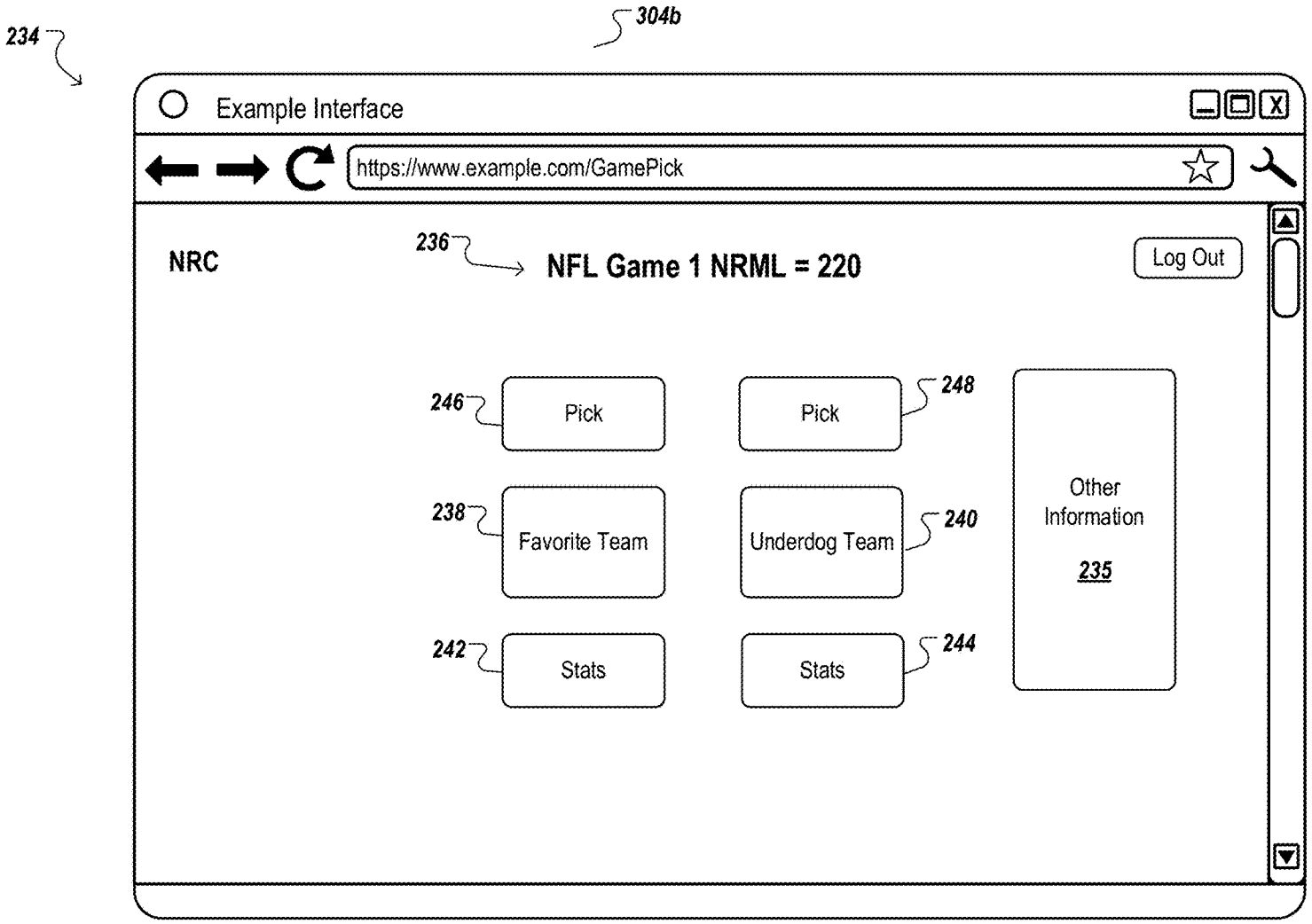

For example, interaction with the button 226 can trigger presentation of the event details interface 234 for the particular event (e.g., game) corresponding to the button 226, as shown in FIG. 2E. The event details interface 234 can list any, or all, of the event information 114 that the wagering platform 102 obtained about the particular event. The information presented can include, for example, the no rake money line 236, the favorite team 238, and the underdog team 240, the number of members in the particular group that have selected the favorite team 238 as the predicted winner, and the number of members in the particular group that have selected the underdog team 240 as the predicted winner. The event details interface 234 could also include other information 235, such as the current total wager that the member would be placing to select the favorite as the predicted winner, the current total wager that the member would be placing to select the underdog as the predicted winner, and/or the current predicted winnings the member could receive if each of the favorite or underdog were correctly selected as the winner. Note, however, that the actual total wagers and/or potential winnings may continue to change over time until wagering on that particular event were locked. As such, the wagering platform can dynamically continue to update the information provided in the event details interface 234 until wagering on that particular event has been locked.

The event details interface 234 can also include statistics about each of the entities (e.g., teams or sports figures) participating in the event or provide statistics buttons (e.g., 242, 244) that trigger presentation of statistics about the entities participating in the event. The event details interface 234 also includes pick buttons (246, 248) that enable the member to submit their pick for the predicted winner of the event. For example, interaction with the button 246 would submit a selection of the favorite team 238 as the predicted winner for the member, while interaction with the button 248 would submit a selection of the underdog 240 as the predicted winner for the member. Upon receipt of the selection of the predicted winner from the member, the wagering platform can update the information presented in subsequent presentations of the event details interface 234 to account for the member's selection of a predicted winner. For example, the wagering platform 102 can update the current total wager that another member would be placing to select the favorite as the predicted winner, the current total wager that other member would be placing to select the underdog as the predicted winner, and/or the current predicted winnings member would receive if each of the favorite or underdog were correctly selected as the winner.

Figure 3:
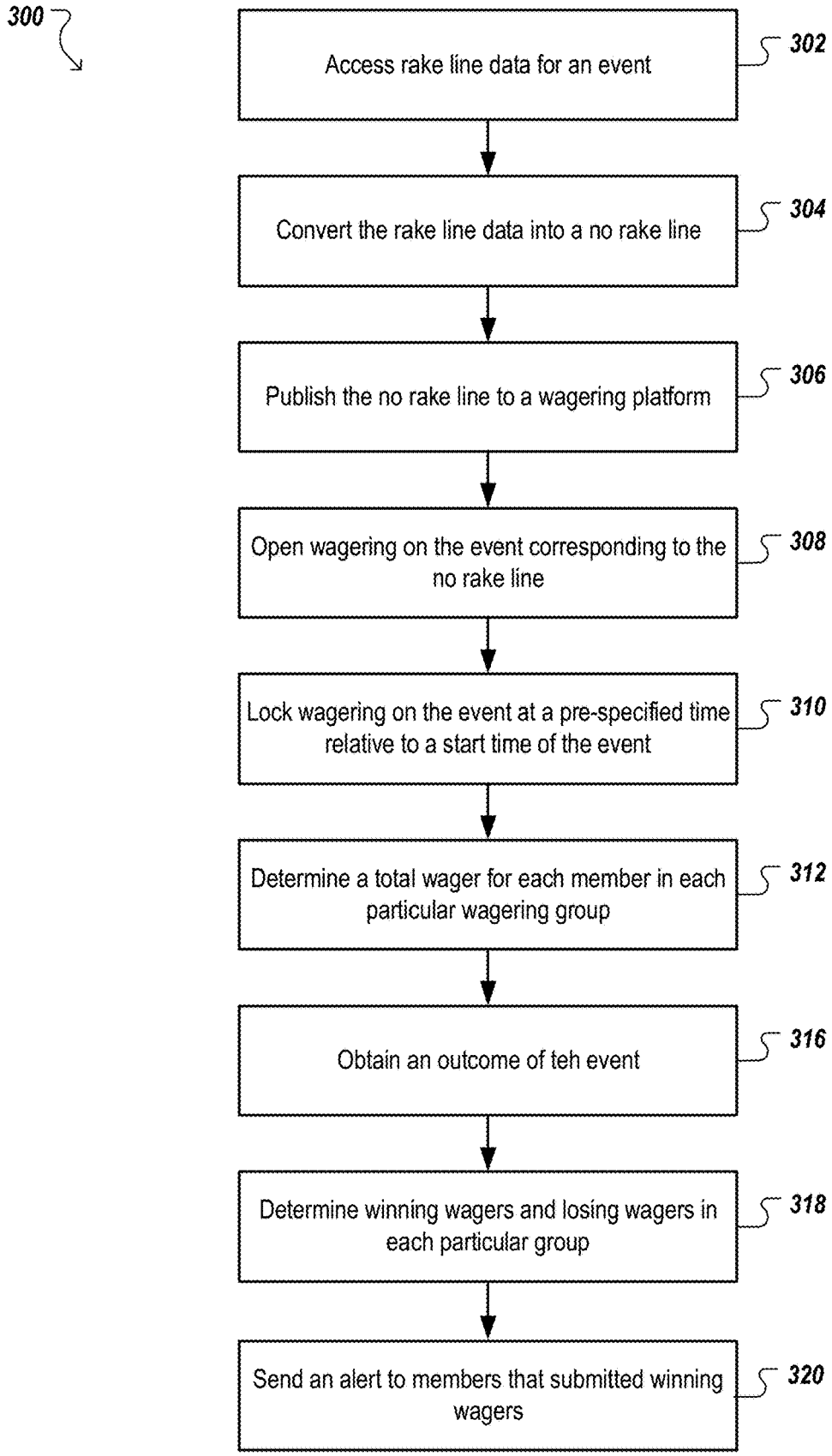
FIG. 3 is a flow chart of an example process of no rake wagering.

FIG. 3 provides an example process that can be performed by the wagering platform 102. Generally speaking, the process 300 can be referred to as a no rake wagering process because the wagering facilitated by the process 300 is performed without the wagering platform 102 collecting money for the wagers placed by members. Operations of the process 300 can be implemented as instructions that are stored on a computer readable medium. The instructions can cause one or more processors to perform operations of the process 300.

Rake line data for a sports event are accessed (302). In some implementations, the rake line data specify a rake line that has been published for the sports event. The rake line includes a published positive rake line specifying an amount that will be won on a wager of a specified amount when a first outcome of the sports event occurs. In some implementations, the published positive rake line specifies a relative amount that will be won when the underdog is the winner. For example, a positive rake line of 120 specifies that $120 will be won on a $100 wager if the team having the +120 rake line wins.

The rake line also includes a published negative rake line specifying an amount required to be wagered in order to win the specified amount when a second outcome of the sports event occurs. In some implementations, the published negative rake line specifies a relative amount that must be wagered in order to win the specified amount. For example, a negative rake line of −120 specifies that $120 must be wagered in order to win $100 if the team having the −120 rake line wins.

The accessed rake line data are converted into a no rake line (304). In some implementations, the accessed rake line data are converted into a no rake line by eliminating a spread between a positive rake line specified by the rake line data and a negative rake line specified by the rake line data. In a particular example, the spread between the positive rake line and the negative rake line by calculating an average of the published positive money line and an absolute value of the published negative money line, as discussed above. Other adjustments can also be made, e.g., based on how the published rake money lines have moved over time. For example, larger movements in one direction or another over a recent time period can be weighted more heavily than older movements in the rake money lines to account for more recent information being considered.

The no rake line is published to a wagering platform accessible by multiple members (306). The wagering platform can include multiple separate wagering groups that each include multiple members. The no rake line can be published by posting the no rake line as discussed above with reference to FIG. 2. The no rake line can also be published by distributing push messages to native mobile applications that provide access to the wagering platform.

For each particular wagering group from among the multiple separate wagering groups, wagering on a sports event (or any other event), can be facilitated by opening up wagering on the sports event corresponding to the no rake line (308). Wagering on the sports event can be opened up at any time, and members of the particular wagering group can select their predicted winner from among the entities competing, as discussed above. While wagering for a particular sports event is open within a particular wagering group, wagers are accepted from members in the particular wagering group. The wagers each specify a predicted outcome of the sporting event picked by the member that submitted the wager. The wagers generally do not need to specify an amount of the wager, as the total amount of the wager is determined based on the baseline wager for the particular group and other factors, as discussed elsewhere in this document. As such, in some implementations, the wagers submitted by the members do not include monetary information.

During the wagering period, the wagering platform can accept updated wagers from members in the particular wagering group. Updated information can be transmitted to other members in the particular wagering group in response to acceptance of the updated wagers, and potential winnings and losses can also be generated and provided in response to the accepted updated wagers. The same aggregate member account balance across all members in the group can be maintained irrespective of the outcome of the sports event.

In some implementations, acceptance of wagers from each particular member can be conditioned upon a wagering limit that is determined for that member. The wagering limit can be determined based on an account balance of that particular member in view of potential exposure of the particular member in the wagering platform. The particular member's ability to select outcomes can be limited based on the determined wagering limit. For example, the particular member's selection of various sports event that will result in that particular member's failure to cover a resulting losing wager can be limited using the wagering limit. In some situation, a given amount of potential losses that the particular member would incur for a given outcome of a particular sports event is monitored.

The given amount of potential losses can be based at least in part on a number of members in a same wagering group as the particular member that picked an opposite outcome than the particular member. For example, as discussed above with reference to FIG. 1, when the particular member has selected the unpopular pick for a particular sports event, that member's potential losses will be based on (e.g., equal to) the total wager for that sports event, which will be greater than the baseline wager for the particular wagering group. However, when the member has selected the popular pick, their potential losses will be equal to the baseline wager.

A total exposure of the particular member can be updated as the given amount of potential losses changes, and the particular member can be restricted from placing additional wagers when a difference between available account resources for the particular member and the total exposure for the particular member falls to a pre-specified threshold. For example, when the difference is an amount that is less than the baseline amount, a maximum possible total wager for a particular sports event, or some other specified amount, the particular member can be prevented from placing additional wagers.

At a pre-specified time relative to a start time of the sports event, wagering on the sports event is locked (310). When wagering is locked, any existing wagers made within the particular group based on the no rake line are also locked in, and the members can no longer adjust their selections of the predicted winders. As discussed above the time at which the wagering is locked can be specified by an administrator of the wagering group. The wagering can be locked at a start time of the sports event or prior to the start time of the sports event. In some situations, an alert can be sent to members of the group to inform the members when wagering will be locked. In some situations, a member may only be informed of upcoming wager locks for sports events on which the member has placed wagers. In other situations, the member may be informed of upcoming wager locks for sports events on which the member has not placed wagers.

After the pre-specified time is reached for the sports event, a total wager for each member in the particular wagering group is determined (312). As discussed above, for a particular sports event, the total wager for each member in the particular wagering group will depend on a number of factors including which entity was selected as the predicted winner by that member, and which entity in the sports event is the popular pick among the members. Members that selected the popular pick as the predicted winner will have their total wager set to the baseline wager for the particular group. Meanwhile, members that selected the unpopular pick as the predicted winner will have their total wagers set as discussed above with reference to FIG. 1 (e.g., based on IMLW*#PP/#UP).

An outcome of the sporting event is obtained (314). The outcome of the sporting event can be obtained, for example, from event information servers 108 in a manner similar to that discussed above with reference to obtaining the event information 114 in FIG. 1.

Winning wagers and losing wagers are determined from among the wagers in the particular group (316). The winning wagers and the losing wagers are determined based on the outcome of the sports event. For example, the winning wagers can be the total wagers of members that selected the winner of the sports event. The losing wagers can be the total wagers of members that selected the lower of the sports event.

Accounts of the members in the particular group that wagered on the sporting event are updated based on the winning wagers and the losing wagers (318). The accounts are updated, for example, by transferring the losing wagers to accounts of members that made the winning wagers. As discussed above, within a particular wagering group, the total amount of losing wagers are equally divided among the members that correctly selected the winner. The accounts of the members can be updated without actually distributing any money to the members, such that a total balance of money (or other assets) within the particular group can remain the same irrespective of the outcome of any sporting event.

An alert is sent when members submit winning wagers (320). In some implementations, members that submit winning wagers can be alerted by the wagering platform, for example, by way of an email, text message, mobile application alert, or by any other appropriate communication technique. In some implementations, all members are alerted as to the outcome of sporting events that they wagered on at the conclusion of that sporting event. These alerts can also be sent by way of any appropriate communication technique. Furthermore, other alerts, such as no rake lines that are above/below a specified threshold (e.g., member specified or system administrator specified) can trigger an alert that the wagering platform automatically sends to one or more of the members, e.g., by way of transmitting an electronic message to the member's device.

Figure 4:
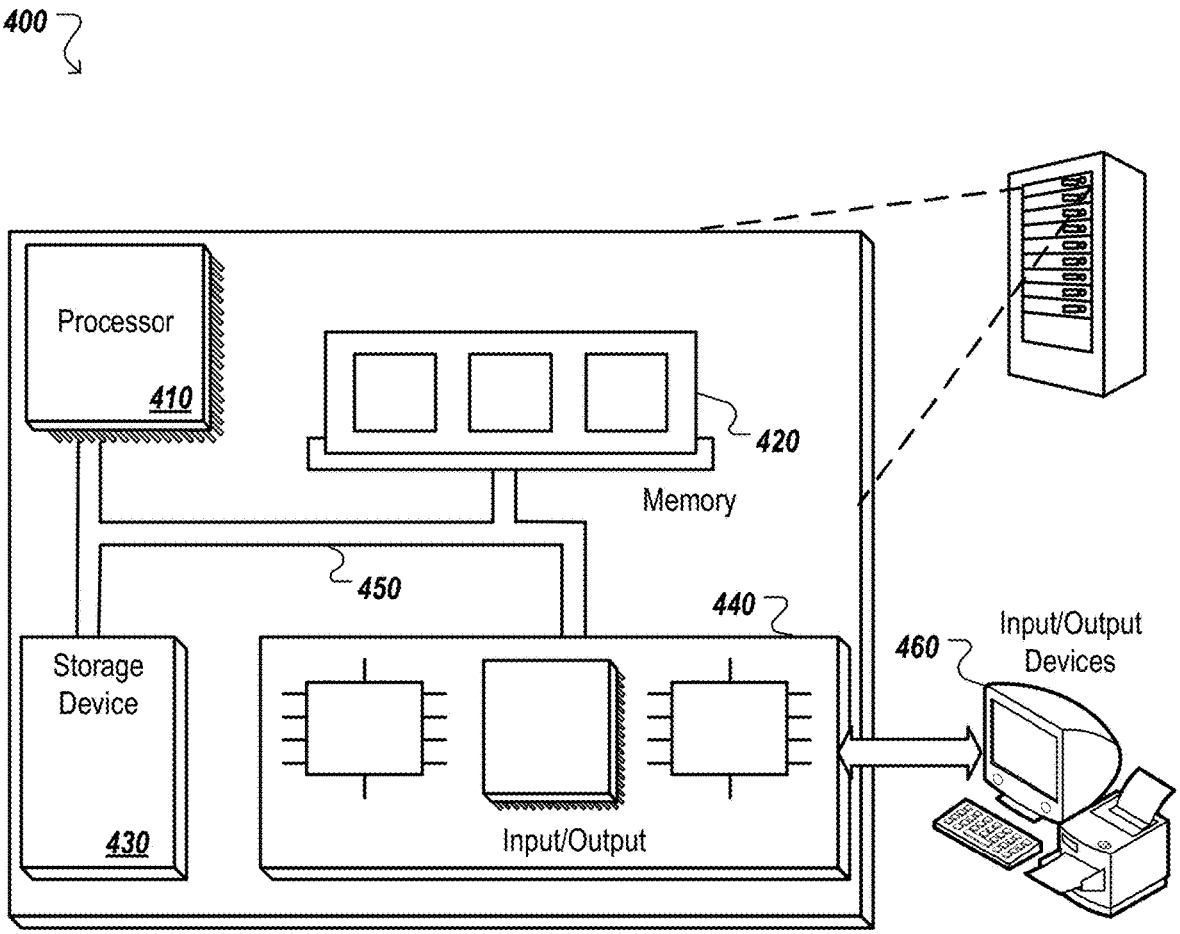
FIG. 4 is a block diagram of an example computer system that can be used to implement no rake wagering.

FIG. 4 is block diagram of an example computer system 400 that can be used to perform operations described above. The system 400 includes a processor 410, a memory 420, a storage device 430, and an input/output device 440. Each of the components 410, 420, 430, and 440 can be interconnected, for example, using a system bus 450. The processor 410 is capable of processing instructions for execution within the system 400. In one implementation, the processor 410 is a single-threaded processor. In another implementation, the processor 410 is a multi-threaded processor. The processor 410 is capable of processing instructions stored in the memory 420 or on the storage device 430.

The memory 420 stores information within the system 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the system 400. In one implementation, the storage device 430 is a computer-readable medium. In various different implementations, the storage device 430 can include, for example, a hard disk device, an optical disk device, a storage device that is shared over a network by multiple computing devices (e.g., a cloud storage device), or some other large capacity storage device.

The input/output device 440 provides input/output operations for the system 400. In one implementation, the input/output device 440 can include one or more of a network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 360. Other implementations, however, can also be used, such as mobile computing devices, mobile communication devices, set-top box television client devices, etc.

Although an example processing system has been described in FIG. 4, implementations of the subject matter and the functional operations described in this specification can be implemented in other types of digital electronic circuitry, or in computer software, firmware, or hardware, including the structures disclosed in this specification and their structural equivalents, or in combinations of one or more of them.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user (e.g., a member), embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML, page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method performed by data processing apparatus, the method comprising:

accessing, by one or more computers of a wagering platform, rake line data for a sports event;

converting, by the one or more computers, the accessed rake line data into a no rake line;

publishing, by the one or more computers, the no rake line to a wagering platform accessible by multiple members, wherein the wagering platform includes multiple separate wagering groups that each include multiple members;

for each particular wagering group from among the multiple separate wagering groups:

at a pre-specified time relative to a start time of the sports event, locking, by the one or more computers, any wagers made within the particular group based on the no rake line;

obtaining, by the one or more computers, an outcome of the sporting event;

determining, by the one or more computers and from among the wagers, winning wagers and losing wagers in the particular group based on the outcome of the sports event and the no rake line;

updating, by the one or more computers, accounts of the members in the particular group that wagered on the sporting event, including transferring the losing wagers to accounts of members that made the winning wagers without requiring an external server call to a financial institute; and alerting one or more members when the one or more members submitted the winning wagers.

2. The method of claim 1, wherein converting the accessed rake line data into a no rake line comprises eliminating a spread between a positive rake line specified by the rake line data and a negative rake line specified by the rake line data.

3. The method of claim 1, wherein converting the accessed rake line into a no rake line comprises:

obtaining, for the sports event, a published positive rake line specifying an amount that will be won on a wager of a specified amount when a first outcome of the sports event occurs;

obtaining, for the sports event, a published negative rake line specifying an amount required to be wagered in order to win the specified amount when a second outcome of the sports event occurs; and calculating an average of the published positive money line and an absolute value of the published negative money line.

4. The method of claim 1, further comprising:

for each particular wagering group from among the multiple separate wagering groups:

accepting, from members in that particular wagering group, wagers that each specify a predicted outcome of the sporting event picked by the member that submitted the wager;

determining, at the pre-specified time, a total wager for each member in the particular wagering group based on a first number of the members in that particular wagering group that picked a first particular outcome of the sporting event and a second number of the members in that particular wagering group that picked a second particular outcome of the sporting event; and determining, for each member in that particular wagering group, the total wager for that sporting event based on the outcome of the sports event, the first number of members that picked the first particular outcome, and the second number of members that picked the second particular outcome, the no rake money line, and a group wager specifying a baseline wager amount for that particular wagering group.

5. The method of claim 4, further comprising:

determining, for a particular member, a wagering limit based on an account balance of that particular member; and limiting access to that particular members selecting outcomes of various sports event that will result in the particular member's failure to cover a resulting losing wager, including:

monitoring a given amount of potential losses that the particular member would incur for a given outcome of a particular sports event based at least in part on a number of members in a same wagering group as the particular member that picked an opposite outcome than the particular member;

updating a total exposure of the particular member as the given amount of potential losses changes; and restricting the particular member from placing additional wagers when a difference between available account resources for the particular member and the total exposure for the particular member falls to a pre-specified threshold.

6. The method of claim 1, further comprising providing, by the one or more computers, a wagering platform that is configured to accept updated wagers from members in a particular wagering group, transmit updated information to other members in the particular wagering group in response to acceptance of the updated wagers, and update potential winnings and losses in response to the accepted updated wagers, wherein the wagering platform is configured to maintain a same aggregate member account balance irrespective of the outcome of the sports event.

7. The method of claim 1, further comprising transmitting to client devices of members in each of the multiple separate different wagering groups status updates during the sports event, the status updates including at least one of a current score of the sports event, a relative amount of time remaining in the sports event, total potential win amounts, or total potential loss amounts for each of the members.

8. The method of claim 1, further comprising:

receiving a request to access the wagering platform;

determining a geographic location of a client device from which the request to access the wagering platform is being submitted;

regulating access to the wagering platform based on the geographic location, including:

denying access to the wagering platform when the request is being submitted from within a geographical region in which access to the wagering platform is prohibited by law; and granting access to the wagering platform when the request is being submitted from within a geographical region in which access to the wagering platform is allowed by law.

9. A system comprising:

a storage device storing executable instructions; and one or more computers operable to interact with the storage device and execute the instructions, wherein execution of the instructions cause the one or more computers to perform operations including:

accessing rake line data for a sports event;

converting the accessed rake line data into a no rake line;

publishing the no rake line to a wagering platform accessible by multiple members, wherein the wagering platform includes multiple separate wagering groups that each include multiple members;

for each particular wagering group from among the multiple separate wagering groups:

at a pre-specified time relative to a start time of the sports event, locking, by the one or more computers, any wagers made within the particular group based on the no rake line;

obtaining an outcome of the sporting event;

determining, from among the wagers, winning wagers and losing wagers in the particular group based on the outcome of the sports event and the no rake line;

updating accounts of the members in the particular group that wagered on the sporting event, including transferring the losing wagers to accounts of members that made the winning wagers without requiring an external server call to a financial institute.

10. The system of claim 9, wherein converting the accessed rake line data into a no rake line comprises eliminating a spread between a positive rake line specified by the rake line data and a negative rake line specified by the rake line data.

11. The system of claim 9, wherein converting the accessed rake line into a no rake line comprises:

obtaining, for the sports event, a published positive rake line specifying an amount that will be won on a wager of a specified amount when a first outcome of the sports event occurs;

obtaining, for the sports event, a published negative rake line specifying an amount required to be wagered in order to win the specified amount when a second outcome of the sports event occurs; and calculating an average of the published positive money line and an absolute value of the published negative money line.

12. The system of claim 9, wherein execution of the instructions cause the one or more computers to perform operations further comprising:

for each particular wagering group from among the multiple separate wagering groups:

accepting, from members in that particular wagering group, wagers that each specify a predicted outcome of the sporting event picked by the member that submitted the wager;

determining, at the pre-specified time, a total wager for each member in the particular wagering group based on a first number of the members in that particular wagering group that picked a first particular outcome of the sporting event and a second number of the members in that particular wagering group that picked a second particular outcome of the sporting event; and determining, for each member in that particular wagering group, the total wager for that sporting event based on the outcome of the sports event, the first number of members that picked the first particular outcome, and the second number of members that picked the second particular outcome, the no rake money line, and a group wager specifying a baseline wager amount for that particular wagering group.

13. The system of claim 12, wherein execution of the instructions cause the one or more computers to perform operations further comprising:

determining, for a particular member, a wagering limit based on an account balance of that particular member; and limiting access to that particular members selecting outcomes of various sports event that will result in the particular member's failure to cover a resulting losing wager, including:

monitoring a given amount of potential losses that the particular member would incur for a given outcome of a particular sports event based at least in part on a number of members in a same wagering group as the particular member that picked an opposite outcome than the particular member;

updating a total exposure of the particular member as the given amount of potential losses changes; and restricting the particular member from placing additional wagers when a difference between available account resources for the particular member and the total exposure for the particular member falls to a pre-specified threshold.

14. The system of claim 9, wherein execution of the instructions cause the one or more computers to perform operations further comprising providing, by the one or more computers, a wagering platform that is configured to accept updated wagers from members in a particular wagering group, transmit updated information to other members in the particular wagering group in response to acceptance of the updated wagers, and update potential winnings and losses in response to the accepted updated wagers, wherein the wagering platform is configured to maintain a same aggregate member account balance irrespective of the outcome of the sports event.

15. The system of claim 9, wherein execution of the instructions cause the one or more computers to perform operations further comprising transmitting to client devices of members in each of the multiple separate different wagering groups status updates during the sports event, the status updates including at least one of a current score of the sports event, a relative amount of time remaining in the sports event, total potential win amounts, or total potential loss amounts for each of the members.

16. The system of claim 9, wherein execution of the instructions cause the one or more computers to perform operations further comprising:

receiving a request to access the wagering platform;

determining a geographic location of a client device from which the request to access the wagering platform is being submitted;

regulating access to the wagering platform based on the geographic location, including:

denying access to the wagering platform when the request is being submitted from within a geographical region in which access to the wagering platform is prohibited by law; and granting access to the wagering platform when the request is being submitted from within a geographical region in which access to the wagering platform is allowed by law.

17. A non-transitory computer readable medium storing instructions that, when executed by one or more data processing apparatus, cause the one or more data processing apparatus to perform operations comprising:

accessing rake line data for a sports event;

converting the accessed rake line data into a no rake line;

publishing the no rake line to a wagering platform accessible by multiple members, wherein the wagering platform includes multiple separate wagering groups that each include multiple members;

for each particular wagering group from among the multiple separate wagering groups:

at a pre-specified time relative to a start time of the sports event, locking, by the one or more computers, any wagers made within the particular group based on the no rake line;

obtaining an outcome of the sporting event;

determining, from among the wagers, winning wagers and losing wagers in the particular group based on the outcome of the sports event and the no rake line;

updating accounts of the members in the particular group that wagered on the sporting event, including transferring the losing wagers to accounts of members that made the winning wagers without requiring an external server call to a financial institute.

18. The non-transitory computer readable medium of claim 17, wherein converting the accessed rake line data into a no rake line comprises eliminating a spread between a positive rake line specified by the rake line data and a negative rake line specified by the rake line data.

19. The non-transitory computer readable medium of claim 17, wherein converting the accessed rake line into a no rake line comprises:

obtaining, for the sports event, a published positive rake line specifying an amount that will be won on a wager of a specified amount when a first outcome of the sports event occurs;

obtaining, for the sports event, a published negative rake line specifying an amount required to be wagered in order to win the specified amount when a second outcome of the sports event occurs; and calculating an average of the published positive money line and an absolute value of the published negative money line.

20. The non-transitory computer readable medium of claim 17, wherein execution of the instructions cause the one or more data processing apparatus to perform operations further comprising:

for each particular wagering group from among the multiple separate wagering groups:

accepting, from members in that particular wagering group, wagers that each specify a predicted outcome of the sporting event picked by the member that submitted the wager;

determining, at the pre-specified time, a total wager for each member in the particular wagering group based on a first number of the members in that particular wagering group that picked a first particular outcome of the sporting event and a second number of the members in that particular wagering group that picked a second particular outcome of the sporting event; and determining, for each member in that particular wagering group, the total wager for that sporting event based on the outcome of the sports event, the first number of members that picked the first particular outcome, and the second number of members that picked the second particular outcome, the no rake money line, and a group wager specifying a baseline wager amount for that particular wagering group.

* * * * *